United States Patent [19]

Crawford et al.

[11] Patent Number: 4,563,026

[45] Date of Patent: Jan. 7, 1986

[54] REPLACEABLE CAM MEMBER FOR KNOTTERS

[75] Inventors: LeRoy A. Crawford, New Holland; Robert E. Jackson, Terre Hill; Earl A. Hudson, Leola, all of Pa.

[73] Assignee: Sperry Corporation, New Holland, Pa.

[21] Appl. No.: 648,919

[22] Filed: Sep. 10, 1984

[51] Int. Cl.[4] ..... B65H 69/04

[52] U.S. Cl. ..... 287/2; 289/8; 289/11

[58] Field of Search ..... 74/567, 569; 289/2, 289/8, 11

[56] References Cited

U.S. PATENT DOCUMENTS

| | | | |
|---|---|---|---|
| 692,483 | 2/1902 | Rueger | 74/567 |
| 3,004,787 | 10/1961 | Walters | 289/11 |
| 3,041,096 | 6/1962 | Kohler | 289/11 |

*Primary Examiner*—Louis K. Rimrodt

*Attorney, Agent, or Firm*—Darrell F. Marquette; Larry W. Miller; Frank A. Seemar

[57] ABSTRACT

A cam member for knotters has a cam section, on which a cam surface is formed, and a flange section. The cam surface is engaged by a cam follower carried on the movable jaw of the knotter billhook. Fasteners such as bolts extend through the flange section of the cam member into the main frame of the knotter to detachably fasten the cam member to the main frame.

5 Claims, 4 Drawing Figures

Fig. 2
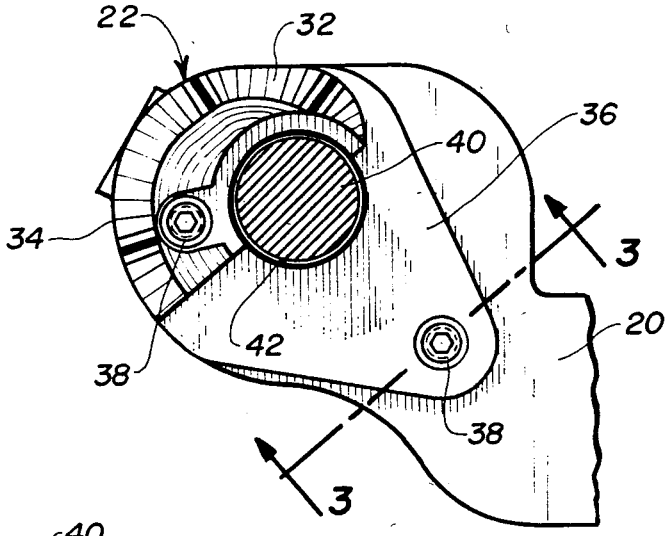
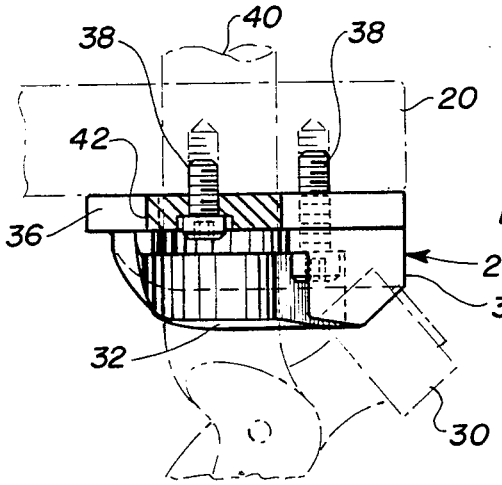
Fig. 3
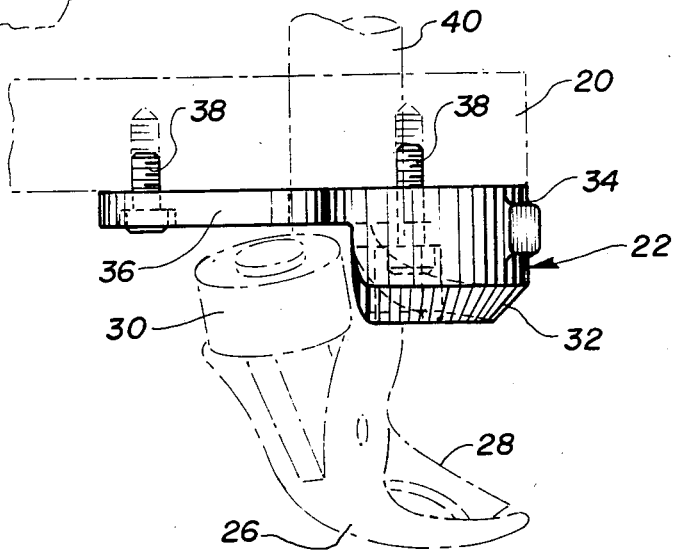
Fig. 4

REPLACEABLE CAM MEMBER FOR KNOTTERS

BACKGROUND AND SUMMARY OF THE INVENTION

This invention relates generally to agricultural balers for making bales of crop material and, in particular, to the knotters used on such balers for securing strands of twine around bales of crop material.

Knotters on agricultural balers generally include a billhook for tying a knot in a strand of twine that has been wrapped around a bale. The billhook usually has a pair of jaws, one of which is movable by providing a cam follower on a heel portion of the movable jaw arranged to engage a cam surface formed on a cam member. Typically, the cam member has been formed as an integral part of the main frame of the knotter. Therefore, when the cam surface becomes so worn that the billhook no longer operates properly and efficiently, the entire main frame of the knotter must be replaced in order to provide a new cam surface for the cam follower. Replacing the knotter main frame requires removal of the knotter from the baler and disassembly of the knotter.

It is an object of the present invention to provide a replaceable cam member for a knotter that may be easily replaced without replacing the entire knotter frame and without removing the knotter from the baler. The replaceable cam member has a cam section, on which a cam surface is formed, and a flange section. Fastener means extend through the flange section into the knotter main frame to detachably fasten the cam member to the knotter main frame.

DESCRIPTION OF THE DRAWINGS

FIG. 2 is an enlarged sectional view taken along lines 2—2 in FIG. 1 illustrating the cam member and a portion of the knotter frame of FIG. 1;

FIG. 3 is a sectional view taken along lines 3—3 in FIG. 2; and

FIG. 4 is another view of the cam member taken from the right in FIG. 3.

DESCRIPTION OF THE PREFERRED EMBODIMENT

Figure 1:
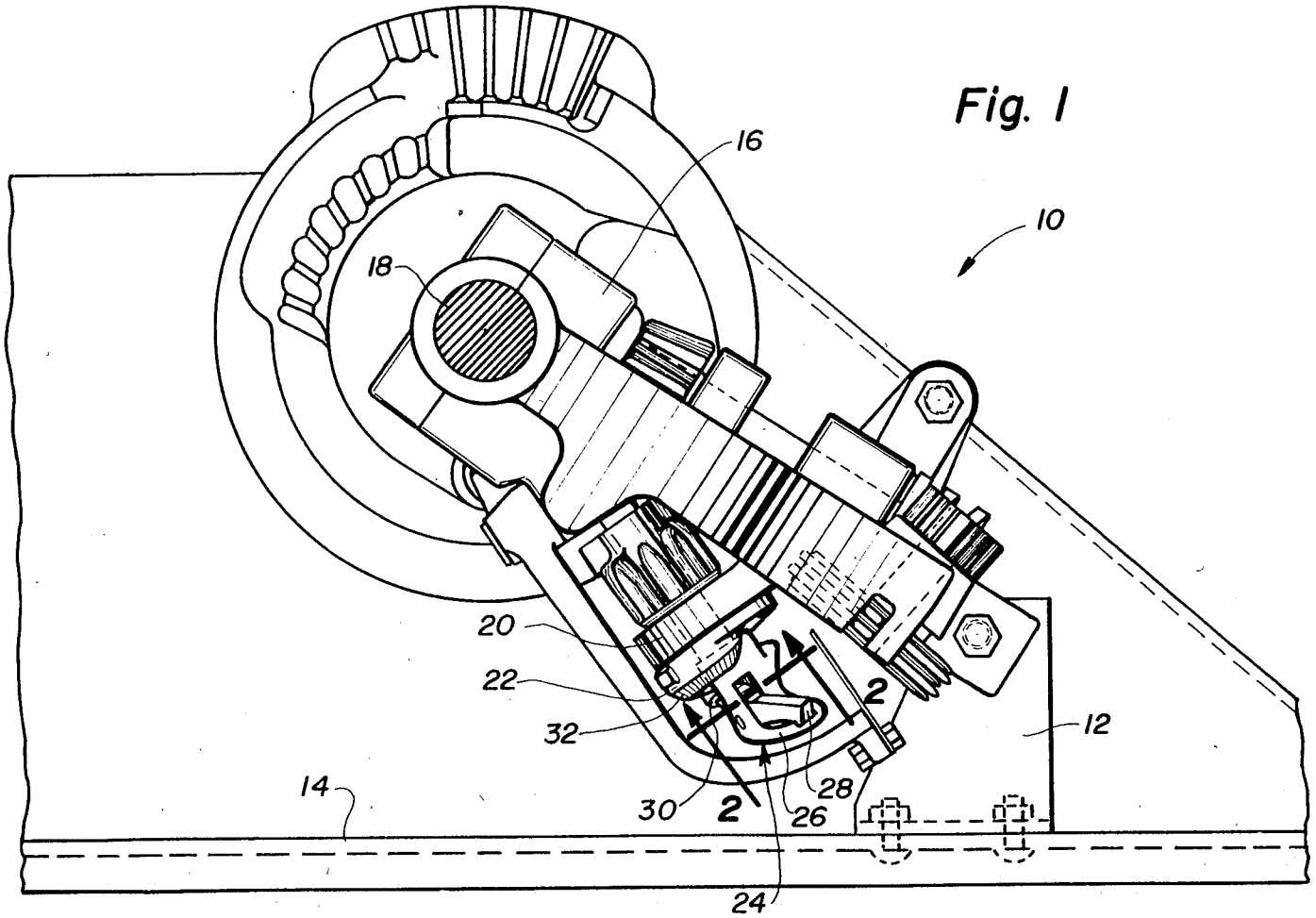
FIG. 1 is a side elevational view of a knotter incorporating the preferred embodiment of the cam member of the present invention.

Referring to FIG. 1, a knotter 10 is partly supported by a bracket 12 mounted on the top wall 14 of a bale case of an agricultural baler. The knotter 10 includes a main frame 16, preferably formed of cast steel, clamped onto a shaft 18 that extends transversely of the bale case above the top wall 14 thereof. Since the knotter 10 is generally of a conventional type, further description of the details and the knot tying operation of the knotter 10 are not considered necessary for a full understanding of the present invention.

The main frame 16 of the knotter 10 has an arm portion 20 thereof disposed below the shaft 18, and a cam member 22 according to the present invention is detachably fastened to the main frame arm portion 20. The knotter 10 includes a billhook 24 rotatably supported on the main frame 16 and having a pair of jaws 26,28 with a cam follower such as roller 30 carried on a heel portion of the jaw 28 for engaging a cam surface 32 on the cam member 22.

As seen in FIGS. 2–4, the cam member 22 includes a cam section 34, on which the cam surface 32 is formed, and a flange section 36. A pair of fasteners such as bolts 38 extend through the flange section 36 and are threaded into the arm portion 20 of the main frame 16 to detachably fasten the cam member 22 to the main frame 16. The shaft 40 of the billhook 24 extends through a hole 42 formed in the flange section 36 of the cam member 22. The hole 42 is located generally between the bolts 38.

If the cam surface 32 of the cam member 22 should become worn to the extent that the billhook jaws 26,28 do not operate properly, the worn cam member 22 may be easily removed from the main frame 16 by removing the bolts 38, and a new cam member 22 may then be installed without replacing the entire main frame 16. It will be understood, of course, that the billhook 24 must be removed from the knotter 10 before replacing the cam member 22.

The following claims are intended to cover all modifications and variations of the preferred embodiment of the present invention without departing from the spirit and scope of the invention.

Having thus described the invention, what is claimed is:

1. In a knotter including a main frame, a billhook supported on said main frame having a pair of jaws, a cam follower carried on one of said pairs of jaws for engaging a cam surface on a cam member, the improvement comprising said cam member having a cam section on which said cam surface is formed and a flange section, and fastener means extending through said flange section into said main frame detachably fastening said cam member to said main frame said flange section having a hole formed therein adjacent said cam section, and said billhook including a shaft extending through said hole.

2. The improvement of claim 1, wherein said fastener means comprises bolts threaded into said main frame.

3. The improvement of claim 2, wherein said bolts are spaced apart with said hole located generally between said bolts.

4. The improvement of claim 1, wherein said cam follower comprises a roller carried on a heel portion of said one of said pair of jaws.

5. The improvement of claim 4, wherein said cam member is fixed on said main frame and said billhook is rotatably mounted on said main frame.

* * * * *